US011410786B2

(12) United States Patent
Murakami et al.

(10) Patent No.: US 11,410,786 B2
(45) Date of Patent: Aug. 9, 2022

(54) RADIOISOTOPE PRODUCTION APPARATUS

(71) Applicant: SUMITOMO HEAVY INDUSTRIES, LTD., Tokyo (JP)

(72) Inventors: Yoshinobu Murakami, Ehime (JP); Francisco Guerra, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 740 days.

(21) Appl. No.: 16/277,520

(22) Filed: Feb. 15, 2019

(65) Prior Publication Data

US 2019/0259505 A1 Aug. 22, 2019

(30) Foreign Application Priority Data

Feb. 19, 2018 (JP) ..... JP2018-026980

(51) Int. Cl.
*G21K 5/08* (2006.01)
*H05H 6/00* (2006.01)
*G21G 1/10* (2006.01)

(52) U.S. Cl.
CPC ..... *G21K 5/08* (2013.01); *G21G 1/10* (2013.01); *H05H 6/00* (2013.01); *H05H 2277/116* (2013.01)

(58) Field of Classification Search
CPC .. G21G 1/00; G21G 1/10; H05H 6/00; H05H 2277/116; G21K 5/08
See application file for complete search history.

(56) References Cited

U.S. PATENT DOCUMENTS 5,784,423 A * 7/1998 Lidsky ..... G21G 1/12 376/156
2003/0015666 A1* 1/2003 Morgan ..... G21G 1/10 250/398
2006/0062342 A1* 3/2006 Gonzalez Lepera .... H05H 6/00 376/195
2010/0086095 A1* 4/2010 Ogasawara ..... G01T 1/00 376/202
2012/0321027 A1* 12/2012 Baurichter ..... G21G 1/10 376/194
2017/0251547 A1* 8/2017 Ito ..... G21G 1/04
2019/0103198 A1* 4/2019 Nolen, Jr ..... G21G 1/10

FOREIGN PATENT DOCUMENTS

JP 2013-167489 A 8/2013

* cited by examiner

*Primary Examiner* — Sharon M Davis
(74) *Attorney, Agent, or Firm* — Michael Best & Friedrich LLP

(57) ABSTRACT

A radioisotope production apparatus includes a particle accelerator, a first target portion on which a charged particle beam emitted from the particle accelerator is incident and through which the charged particle beam passes, and a second target portion on which the charged particle beam passing through the first target portion is incident. In the first target portion, a target material is held in a beam passage, and a cooling gas supply unit which blows a cooling gas to the target material is provided. In a second target portion, a target substrate is held on a beam axis and a downstream-side surface of the target substrate with respect to the charged particle beam is cooled by cooling water. A total thickness of target foils of the first target portion on the beam axis is smaller than a thickness of the target substrate of the second target portion on the beam axis.

3 Claims, 3 Drawing Sheets

RADIOISOTOPE PRODUCTION APPARATUS

RELATED APPLICATIONS

Priority is claimed to Japanese Patent Application No. 2018-026980, filed Feb. 19, 2018, the entire content of which is incorporated herein by reference.

BACKGROUND

Technical Field

Certain embodiment of the present invention relates to a radioisotope production apparatus.

Description of Related Art

In the related art, as a technique in a field of a radioisotope production apparatus, a radioisotope production apparatus is known. This radioisotope production apparatus includes a target device which holds a target. The target device is mounted on a particle accelerator in a state of holding the target, the target is irradiated with a charged particle beam from the particle accelerator, and thus, a radioactive isotope is generated in the target by a nuclear reaction.

SUMMARY

According to an embodiment of the present invention, there is provided a radioisotope production apparatus which irradiates a target material with a charged particle beam to produce a radioactive isotope, the apparatus including: a particle accelerator which emits the charged particle beam along a predetermined beam axis; a first target portion on which the charged particle beam emitted from the particle accelerator is incident and through which the charged particle beam passes; and a second target portion on which the charged particle beam having passed through the first target portion is incident, in which the first target portion includes a beam passage through which the charged particle beam passes, a target material holding portion which holds a first target material on the beam axis in the beam passage, and a cooling gas supply unit which supplies a cooling gas for cooling the first target material, the second target portion includes a substrate holding portion which holds a target substrate, which includes a substrate body and a second target material provided on the substrate body, on the beam axis, and a cooling water supply unit which supplies cooling water for cooling the target substrate to a downstream-side surface of the target substrate with respect to the charged particle beam, and a total thickness of the first target material and the target material holding portion of the first target portion on the beam axis is smaller than a thickness of the target substrate on the beam axis.

Moreover, the first target portion may include a plurality of the target material holding portions. In addition, the first target material may be inserted onto and extracted from the beam axis in a direction intersecting the beam axis.

DETAILED DESCRIPTION

Figure 1:
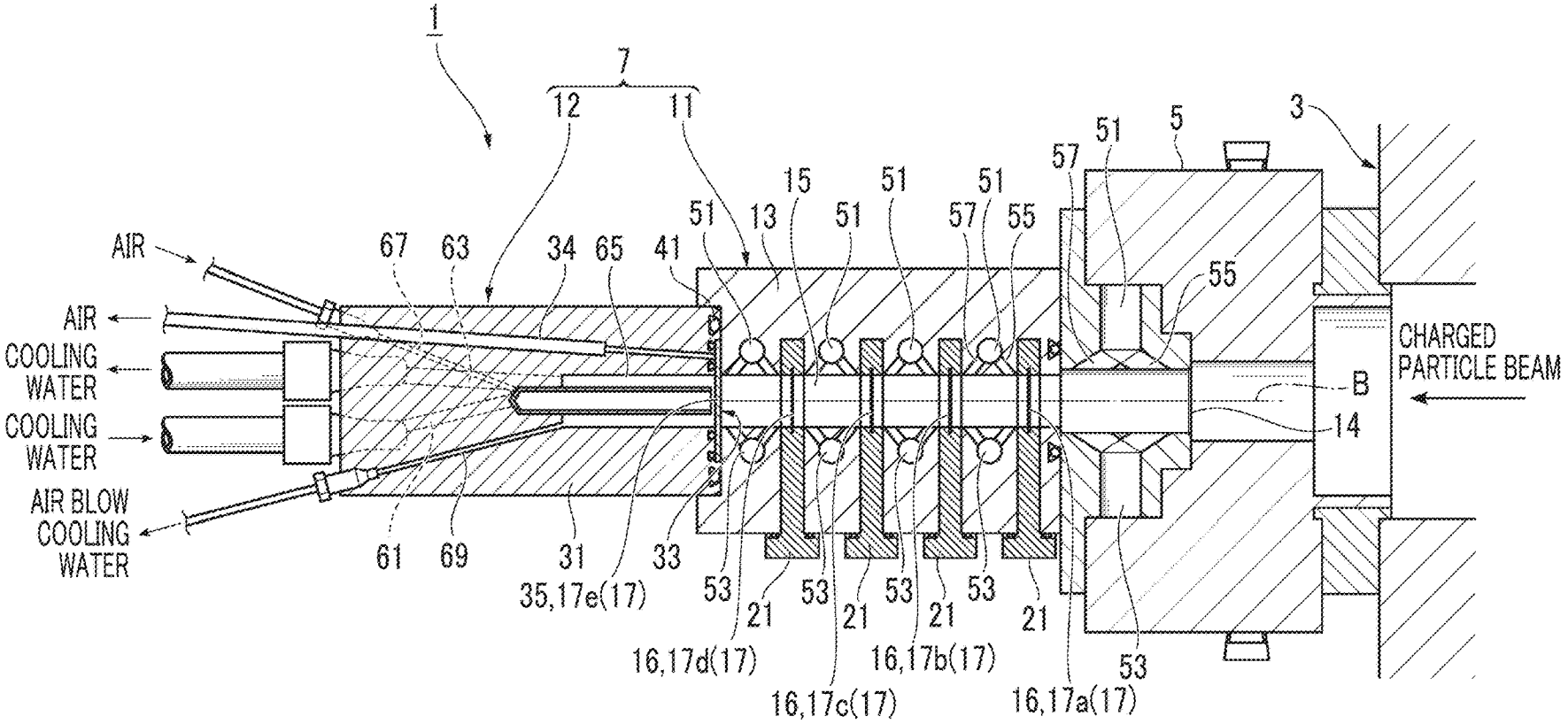
FIG. 1 is a sectional view showing a radioisotope production apparatus according to an embodiment.

In recent years, a demand for a radioactive isotope has increased, and it is desired to improve a yield of the radioactive isotope in this type of radioisotope production apparatus. It is desirable to provide a radioisotope production apparatus which improves the yield of the radioactive isotope.

Hereinafter, an embodiment of a radioisotope production apparatus according to the present invention will be described with reference to the drawings. In addition, in the descriptions, the same reference numerals are assigned to the same elements or elements having the function, and overlapping descriptions thereof are omitted.

A radioisotope production apparatus 1 will be described with reference to FIGS. 1 and 2. The radioisotope production apparatus 1 is an apparatus which irradiates the target material 17 with a charged particle beam and generates a radioactive isotope by a nuclear reaction. The radioisotope production apparatus 1 includes a particle accelerator 3 which accelerates a charged particle to emit a charged particle beam with predetermined energy, and a target device 7 which holds the target material 17 and is mounted on a manifold 5 of the particle accelerator 3.

Examples of nuclides of radioactive isotope produced by the radioisotope production apparatus 1 include $^{64}Cu$, $^{89}Zr$, $^{76}Br$, $^{124}I$, $^{123}I$, $^{62}Zn$, or the like. In addition, $^{64}Ni$, natural Y ($^{89}Y$), $Cu_2{}^{76}Se$, $^{124}TeO_2$, $^{123}TeO_2$, natural Cu, or the like is used as the material of the target material 17 for producing the nuclide.

In a case where the material of the target material 17 is $^{64}Ni$, for example, the material is granular and $^{64}Ni$ is fixed to a substrate formed of gold by electroplating so as to be used. In addition, a proton beam (proton beam composed of positive ions of hydrogen) is emitted from the particle accelerator 3, and a nuclide $^{64}Cu$ is produced by a nuclear reaction of $^{64}Ni(p,n)^{64}Cu$. In the case where the material of the target material 17 is the natural Y ($^{89}Y$), for example, the material is formed in a foil shape, and the foil is physically fixed (plug-in type or the like) to the substrate formed of gold so as to be used. The proton beam is emitted from particle accelerator 3, and a nuclide $^{89}Zr$ is produced by a nuclear reaction of $^{89}Y(p,n)^{89}Zr$. In a case where the material of the target material 17 is $Cu_2{}^{76}Se$, for example, the material is granular and $Cu_2{}^{76}Se$ is fixed to a substrate formed of platinum by sintering so as to be used. The proton beam is emitted from particle accelerator 3, and a nuclide $^{76}Br$ is produced by a nuclear reaction of $^{76}Se(p,n)^{76}Br$.

In a case where the material of the target material 17 is $^{124}TeO_2$, for example, the material is granular and $^{124}TeO_2$ is fixed to a substrate formed of platinum by sintering so as to be used. In addition, the proton beam is emitted from the particle accelerator 3, and a nuclide $^{124}I$ is produced by a nuclear reaction of $^{124}Te(p,n)^{124}I$. In a case where the material of the target material 17 is $^{123}TeO_2$, for example, the material is granular and $^{123}TeO_2$ is fixed to a substrate formed of platinum by sintering so as to be used. Moreover, the proton beam is emitted from the particle accelerator 3, and a nuclide $^{123}I$ is produced by a nuclear reaction of $^{123}Te(p,n)^{123}I$. In the case where the material of the target material 17 is the natural Cu, for example, the material is formed in a foil shape, and the foil is physically fixed (plug-in type, or the like) to a substrate formed of gold so as to be used. In addition, the proton beam is emitted from the particle accelerator 3, a nuclide $^{62}Zn$ is produced by a nuclear reaction of $^{63}Cu(p,2n)^{62}Zn$.

For example, a cyclotron, a linear accelerator (linac) or the like is used as the particle accelerator 3. For example, a proton beam, a heavy proton beam, a α ray, or the like is used as the charged particle beam. In the following descriptions, words such as an "upstream side" or a "downstream side" are used corresponding to an upstream and a downstream of the charged particle beam emitted from the particle accelerator 3. In addition, a beam axis of the charged particle beam emitted from the particle accelerator 3 is denoted by a reference numeral "B" in the drawings. The beam axis is a trajectory of the charged particle beam at a position and an extension line of the trajectory.

The target device 7 can hold the plurality of target materials 17 on the beam axis B. As shown in the drawings, in the present embodiment, the target device 7 can hold a total of five target materials 17 on the beam axis B. Details of a structure for holding the target materials 17 will be described later. The target device 7 includes a first target portion 11 connected to an immediate downstream side of the manifold 5 and a second target portion 12 connected to an immediate downstream side of the first target portion 11. The charged particle beam emitted from the particle accelerator 3 is incident onto the first target portion 11 and passes through the first target portion 11. Then, the charged particle beam passing through the first target portion 11 is incident onto the second target portion. A beam passage 15 is provided from manifold 5 to the first target portion 11. The beam axis B passes through the beam passage 15 and the charged particle beam passes through the beam passage 15. A vacuum foil 14 is installed in the beam passage 15 of the manifold 5, and the vacuum foil 14 seals the beam passage 15 in a vacuum state.

First Target Portion

For example, the first target portion 11 includes a body barrel portion 13 having a square column shape, and a through-hole having a circular cross section is formed in a center of the body barrel portion 13 so as to penetrate the body barrel portion 13 in a direction of the beam axis B. The through-hole constitutes a portion of the above-described beam passage 15.

Figure 3A:
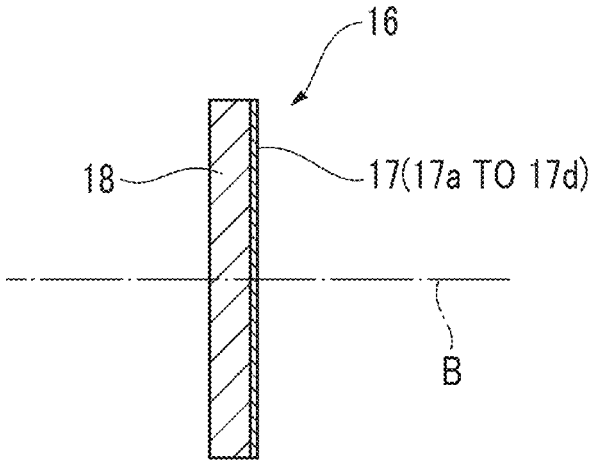
FIG. 3A is an enlarged sectional view of a target foil and FIG. 3B is an enlarged sectional view of a target substrate.

The first target portion 11 includes four target holders 21 which are attachable to and detachable from the body barrel portion 13. One target foil 16 can be attached to each target holder 21. As shown in FIG. 3A in an enlarged manner, in the present embodiment, the target foil 16 includes a gold foil 18 (target material holding portion) and a target material 17 which is formed on an upstream-side surface of the gold foil 18. For example, the target material 17 is formed by sintering or plating a target substance for obtaining a target radioactive isotope on the surface of the gold foil 18.

A holder body portion 21*a* of the target holder 21 is formed in a flat plate shape having a thickness in the direction of the beam axis B. In the holder body portion 21*a*, a beam through-hole 25 constituting a portion of the beam passage 15 is formed to penetrate the holder body portion 21*a* in a thickness direction, and the film-shaped target foil 16 is attached to the inside of the beam through-hole 25 (target material holding portion). Meanwhile, a slit 23 into which the holder body portion 21*a* of each target holder 21 is inserted is formed in the body barrel portion 13. The slit 23 is cut in a direction (in a direction perpendicular to the beam axis B in the present embodiment) intersecting the beam axis B from a side wall surface of the body barrel portion 13 to a position crossing the beam passage 15.

The holder body portion 21*a* of the target holder 21 is inserted into or extracted from the slit 23, and thus, the target foil 16 can be inserted onto or extracted from the beam axis B in the direction (in the direction perpendicular to the beam axis B in the present embodiment) intersecting the beam axis B. In addition, in a state where the holder body portion 21*a* is inserted into the slit 23, the target foil 16 is positioned in the beam passage 15 and is positioned to cross the beam axis B. According to the above-described structure, in the first target portion 11, a total of four target materials 17 are linearly disposed on the beam axis B in the beam passage 15. When the target materials 17 of the four target foils 16 are distinguished from each other, the target materials 17 are referred to as a target material 17*a*, a target material 17*b*, a target material 17*c*, and a target material 17*d* in order from the upstream side.

In addition, a portion of the target holder 21 other than the holder body portion 21*a* protrudes toward the side wall surface of the body barrel portion 13 as a knob portion 21*b*. The knob portion 21*b* is held by a predetermined actuator or the like, and thus, attachment/detachment operations of the target holders 21 to/from the body barrel portion 13 are performed smoothly. An O ring 27 is provided on a portion of the knob portion 21*b* facing the side wall surface of the body barrel portion 13. The O ring 27 is interposed between the knob portion 21*b* and the side wall surface of the body barrel portion 13, and thus, the beam passage 15 is sealed in a vacuum state.

Second Target Portion

Figure 2:
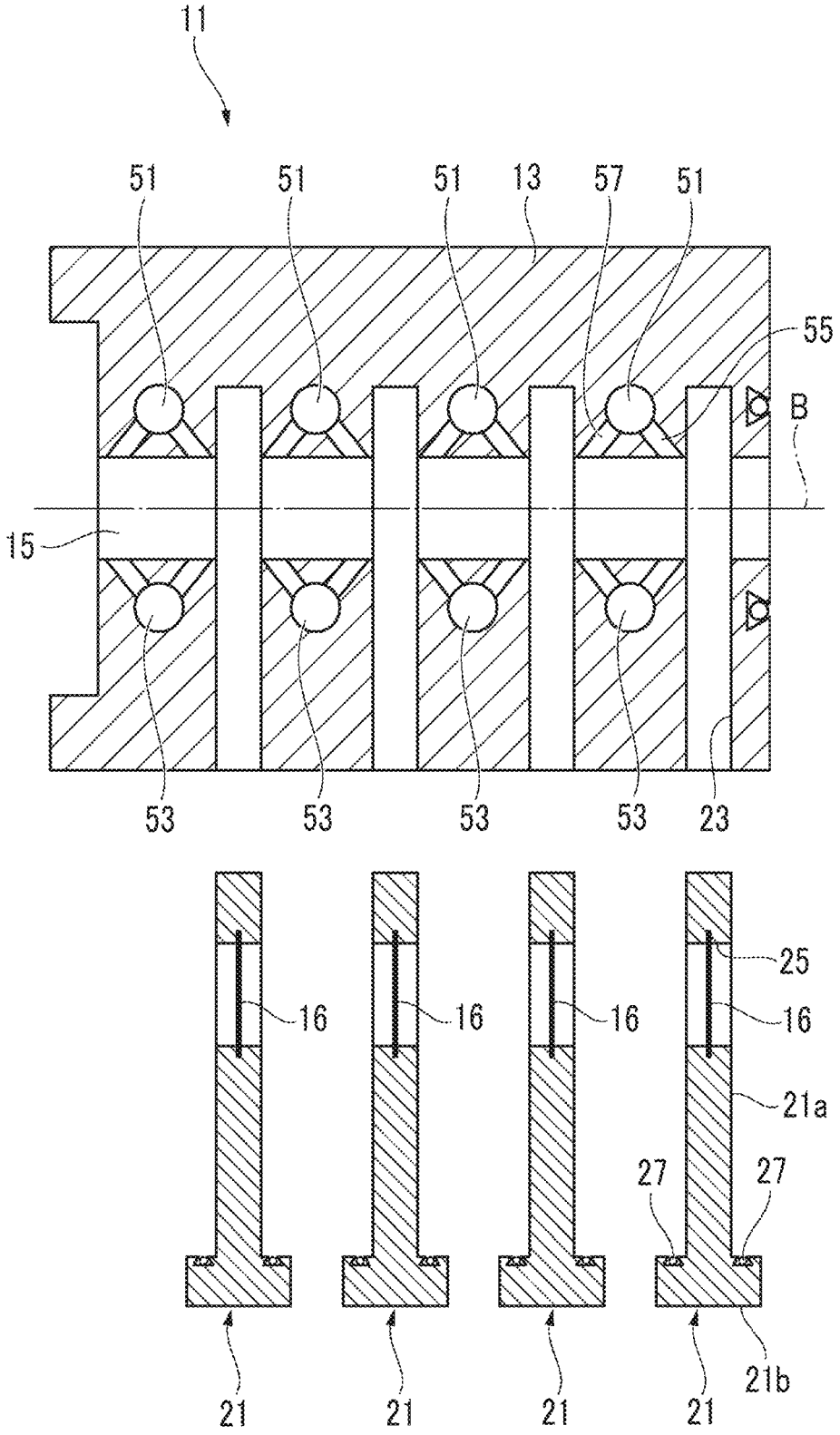
FIG. 2 is an exploded sectional view of a first target portion.

As shown in FIG. 1, for example, the second target portion 12 includes a body portion 31 having a columnar shape. A substrate holding portion 33 which holds a target substrate 35 is formed in the body portion 31. The substrate holding portion 33 has a circular concave portion formed on a front end surface of the body portion 31 and a vacuum hole 34 is opened in the concave portion. A disk-shaped target substrate 35 is fitted into the concave portion, and the target substrate 35 is held by the substrate holding portion 33 by evacuating the target substrate 35 through the vacuum hole 34. In addition, an O ring 41 is installed on the front end surface of the body portion 31 so as to surround the substrate holding portion 33. The O ring 41 is interposed between the first target portion 11 and the second target portion 12 and the beam passage 15 is sealed in a vacuum state.

Figure 3B:
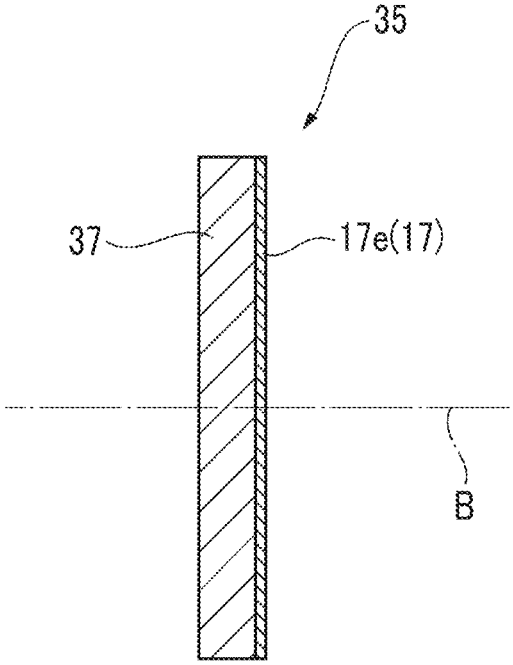

As shown in FIG. 3B in an enlarged manner, for example, the target substrate 35 includes a circular substrate body 37 formed of a predetermined material and the target material 17 which is formed on an upstream-side surface of the substrate body 37. The target material 17 is formed by sintering or plating a target substance for obtaining a target radioactive isotope on the surface of the substrate body 37. Alternatively, the target material 17 is formed by bonding a foil formed of a target substance for obtaining the target radioactive isotope to the surface of the substrate body 37. For example, as the material of the substrate body 37, gold, platinum, or the like is used. In a case where the target material 17 of the target substrate 35 is distinguished from other target materials 17, the target material is referred to as a target material 17*e*. As shown in FIG. 1, the target substrate 35 held by the substrate holding portion 33 blocks a rear end surface of the beam passage 15, and thus, the target material 17*e* is positioned on the beam axis B.

According to the configuration of the radioisotope production apparatus 1 as described above, the vacuum foil 14, the four target materials 17*a* to 17*d* (first target materials) held by the first target portion 11, and one target material 17*e* (second target material) held by the second target portion 12 are linearly arranged on the beam axis B. In addition, the charged particle beam emitted from the particle accelerator 3 sequentially passes through the vacuum foil 14 and the target materials 17*a* to 17*d* and reaches the target material 17*e*. In this time, the five target materials 17*a* to 17*e* are respectively irradiated with the charged particle beam, and thus, in each of the target materials 17*a* to 17*e*, a radioactive isotope is generated by a nuclear reaction. In this case, it is preferable that the charged particle beam is stopped by the substrate body 37 without passing through the target substrate 35.

Here, since each target foil 16 functions as a degrader, energy of the charged particle beam passing through the beam passage 15 decreases as the charged particle beam goes to the downstream side. Therefore, the energy of the charged particle beam applied to each of the target materials 17*a* to 17*e* decreases as the charged particle beam goes the downstream side. Meanwhile, optimum energy for increasing generation efficiency of radioactive isotope differs for each nuclide. Based on this finding, it is not necessary for all the target materials 17*a* to 17*e* to be the same nuclide, and there may be plural kinds of different nuclides among the respective target materials 17*a* to 17*e*. In addition, a thickness of each target foil 16 or the nuclide of each of the target materials 17*a* to 17*e* may be determined such that the energy of the charged particle beam is optimized with respect to the nuclide of each of the target materials 17*a* to 17*e* and the generation efficiency of the radioactive isotope is optimized.

In addition, a total thickness of the four target materials 17*a* to 17*d* and the four gold foils 18 of the first target portion 11 on the beam axis B is smaller than a total thickness of the target material 17*e* and the substrate body 37 of the second target portion 12 on the beam axis B. In other words, a total of the thicknesses of the four target foils 16 on the beam axis B is smaller than a thickness of the target substrate 35. According to this condition, the charged particle beam from the particle accelerator 3 can be set to pass through the four target foils 16 of the first target portion 11 and to be stopped without passing through the substrate body 37 of the target substrate 35 on the downstream side.

Cooling Means of Target or the Like

In the radioisotope production apparatus 1, the vacuum foil 14, the target foils 16, and the target substrate 35 are irradiated with charged particle beams, and thus, it is necessary to appropriately cool them. The radioisotope production apparatus 1 has the following configuration for cooling the vacuum foil 14, the target foils 16, and the target substrate 35 (hereinafter, collectively referred to as a "cooling object").

The radioisotope production apparatus 1 includes five cooling gas supply units 51 which supplies a cooling gas fed from a cooling gas source (not shown) into the beam passage 15 and blows the cooling gas to the cooling object. For example, helium gas is used as the cooling gas. The respective cooling gas supply units 51 are arranged one by one between the cooling objects in the direction of the beam axis B. The cooling gas supply unit 51 positioned first from the upstream side is provided in the manifold 5, and the cooling gas supply unit 51 positioned at the second to fifth positions from the upstream side are provided in the body barrel portion 13 of the first target portion 11. Cooling gas discharge units 53 which discharge the cooling gas from the beam passage 15 are provided one by one at positions facing the respective cooling gas supply units 51 in a state where the beam passage 15 is interposed therebetween.

Each cooling gas supply unit 51 includes an upstream-side blowing flow path 55 through which the cooling gas is obliquely blown toward a downstream-side surface of the cooling object positioned on the upstream side, and a downstream-side blowing flow path 57 through which the cooling gas is obliquely blown toward an upstream-side surface of the cooling object positioned on the downstream side. According to the cooling gas supply unit 51, the cooling gas is blown from both surfaces of the upstream-side surface and the downstream-side surface of each target foil 16, and thus, the target foil 16 is cooled. In addition, the cooling gas is blown to the downstream-side surface of the vacuum foil 14, and thus, the vacuum foil 14 is cooled. Moreover, in the target substrate 35, cooling gas is blown to an upstream-side surface, and the cooling water comes in contact with a downstream-side surface, as will be described later, and thus, both surfaces are cooled.

The radioisotope production apparatus 1 includes a cooling water supply unit for water-cooling the target substrate 35. Specifically, the body portion 31 of the second target portion 12 is provided with a cooling water supply path 61 through which the cooling water is supplied to the target substrate 35 and a cooling water discharge path 63 through which the cooling water is discharged. The cooling water flows through the cooling water space 65 having the target substrate 35 as a cover and comes into contact with the downstream-side surface of the target substrate 35 to cool the target substrate 35. In addition, the body portion 31 is provided with an air blow channel 67 and an air blow discharge channel 69 so as to completely discharge the cooling water from the inside of the body portion 31. As described above, the target substrate 35 is cooled by the cooling gas from the upstream side and is cooled by the cooling water from the downstream side.

Effects of the above-described radioisotope production apparatus 1 will be described. The radioisotope production apparatus 1 includes the first target portion 11 and the second target portion 12 which respectively hold the target materials 17 on beam axis B. The target materials 17 held by the first target portion 11 are irradiated with the charged particle beam from the particle accelerator 3, the charged particle beam passes through the target material 17, and thereafter, the target material 17 held by the second target portion 12 is also irradiated by the charged particle beam. That is, the plurality of target materials 17 are simultaneously irradiated with the charged particle beam, and a radioactive isotope is simultaneously generated in the plurality of target materials 17. Therefore, a yield of the radioactive isotope is improved. In addition, as described above, if a plurality of kinds of different nuclides exist in the respective target materials 17*a* to 17*e*, it is also possible to simultaneously obtain a plurality of kinds of nuclide radioactive isotopes.

In addition, the first target portion 11 itself can hold the plurality of target materials 17*a* to 17*d*, and the radioactive isotope is simultaneously generated in the target materials 17*a* to 17*d*. Therefore, the yield of the radioactive isotope as described above is further improved. In addition, since both surfaces of the target material 17 are cooled and cooling efficiency increase, constraints on heat input due to irradiation with the charged particle beam are alleviated, and as a result, the target material 17 can be thickened. Therefore, it is possible to improve the yield of the radioactive isotope by thickening the target material 17.

Moreover, in general, since it is difficult to change the energy of the charged particle beam emitted from a cyclotron, in the related art, the vacuum foil 14 is set to degrader, and the energy of the charged particle beam applied to the target material 17 needs to decrease to an optimum value. Meanwhile, in the radioisotope production apparatus 1, the target foil 16 positioned on the upstream side functions as a degrader for the target foil 16 or the target substrate 35 positioned on the downstream side. Therefore, as described above, by adjusting the thickness or the like of each target foil 16, it is possible to adjust the energy of the charged particle beam applied to each target material 17 to energy capable of obtaining high generation efficiency.

Moreover, in the second target portion 12, the method of inserting the target holders 21 into the body barrel portion 13 so as to install the target material 17 is adopted, and thus, the installation and the discharge of the target material 17 can be easily performed. In addition, it is possible to automate the installation and discharge of the target material 17, and as a result, compared with a case where the installation and discharge of the target material 17 are performed manually, an exposure of an operator can be reduced.

The present invention can be implemented in various forms including various modifications and improvements based on a knowledge of a person skilled in the art, including the above-described embodiment. Further, it is also possible to constitute a modification example of the embodiment by using the technical matters described in the above embodiment. The configurations of the embodiment may be appropriately combined. For example, the number of the target foils 16 which can be held by the first target portion 11 is not limited to four as in the embodiment and may be increased or decreased appropriately, or one first target portion 11 may be provided. Moreover, in the embodiment, the target foil 16 includes the gold foil 18 and the target material 17 formed on the upstream-surface of the gold foil 18. However, the target material 17 may use the target material 17, which is formed in a foil shape, as the target foil 16 as it is.

It should be understood that the invention is not limited to the above-described embodiment, but may be modified into various forms on the basis of the spirit of the invention. Additionally, the modifications are included in the scope of the invention.

What is claimed is:

1. A radioisotope production apparatus which irradiates a target material with a charged particle beam to produce a radioactive isotope, the apparatus comprising:

a particle accelerator which emits the charged particle beam along a predetermined beam axis;

a first target portion on which the charged particle beam emitted from the particle accelerator is incident and through which the charged particle beam passes; and a second target portion on which the charged particle beam having passed through the first target portion is incident, wherein the first target portion includes:

a body barrel portion, a beam passage which is formed through the body barrel portion and through which the charged particle beam passes, a target holder which is attachable to and detachable from the body barrel portion, a target material holding portion which is formed in the target holder and is configured to hold a first target material on the beam axis in the beam passage, and a cooling gas supply unit which supplies a cooling gas for cooling the first target material;

wherein the second target portion includes:

a body portion, a substrate holding portion which is formed in the body portion and is configured to hold a target substrate, the target substrate includes a substrate body and a second target material provided on the substrate body, on the beam axis, and a cooling water supply unit which supplies cooling water for cooling the target substrate to a downstream-side surface of the target substrate with respect to the charged particle beam; and wherein a total thickness of the first target material and the target material holding portion of the first target portion on the beam axis is smaller than a thickness of the target substrate on the beam axis.

2. The radioisotope production apparatus according to claim 1, wherein the first target portion includes a plurality of the target material holding portions.

3. The radioisotope production apparatus according to claim 1, wherein the first target material is inserted onto and extracted from the beam axis in a direction intersecting the beam axis.

* * * * *